US008939805B2

(12) United States Patent
Miller

(10) Patent No.: US 8,939,805 B2
(45) Date of Patent: Jan. 27, 2015

(54) AIR-PROPELLED WATERCRAFT HAVING AN INFLATABLE HULL

(76) Inventor: Billy D. Miller, Embudo, NM (US)

( * ) Notice: Subject to any disclaimer, the term of this patent is extended or adjusted under 35 U.S.C. 154(b) by 39 days.

(21) Appl. No.: 13/458,770

(22) Filed: Apr. 27, 2012

(65) Prior Publication Data

US 2013/0189883 A1 Jul. 25, 2013

Related U.S. Application Data

(60) Provisional application No. 61/590,663, filed on Jan. 25, 2012.

(51) Int. Cl.

| | |
|---|---|
| ***B63H 7/02*** | (2006.01) |
| ***B63B 1/10*** | (2006.01) |
| ***B63B 1/12*** | (2006.01) |
| ***B63B 7/00*** | (2006.01) |
| ***B63B 7/08*** | (2006.01) |

(52) U.S. Cl.

USPC ..... 440/37; 114/43; 114/61.1; 114/61.25; 114/345

(58) Field of Classification Search

CPC ..... B63H 7/00; B63H 7/02; B63B 7/08; B63B 7/082; B63B 7/085; B63B 7/087; B63B 1/12; B63B 1/121; B63B 1/14; B60V 1/08

USPC ..... 440/37; 114/61.1, 61.25, 272, 273, 345, 114/354, 43; 180/116–120

See application file for complete search history.

(56) References Cited

U.S. PATENT DOCUMENTS

| | | | | |
|---|---|---|---|---|
| 4,724,785 | A * | 2/1988 | Van Hauwaert | 440/37 |
| 5,112,257 | A * | 5/1992 | Grise | 440/37 |
| 7,090,549 | B2 * | 8/2006 | Garcia | 440/37 |
| 8,167,668 | B2 | 5/2012 | Robicheaux | |
| 2006/0073745 | A1 * | 4/2006 | Ficht et al. | 440/37 |
| 2007/0134999 | A1 * | 6/2007 | Ficht et al. | 440/37 |

FOREIGN PATENT DOCUMENTS

| | | | | |
|---|---|---|---|---|
| GB | 2174958 | A * | 11/1986 | B63B 7/00 |

* cited by examiner

*Primary Examiner* — Ajay Vasudeva
(74) *Attorney, Agent, or Firm* — Merchant & Gould P.C.

(57) ABSTRACT

A watercraft has a fan propeller, a motor coupled to the fan propeller, an inflatable hull including a first inflatable member and a second inflatable member, and a platform, which is positioned between the first and second inflatable members and coupled to a base of the fan propeller. The motor powers the fan propeller and thereby propels the inflatable hull in a forward direction. The watercraft is suitable for use in varying water environments including white water, open sea water, ice, snow, and shallow water.

18 Claims, 4 Drawing Sheets

AIR-PROPELLED WATERCRAFT HAVING AN INFLATABLE HULL

CROSS-REFERENCE TO RELATED APPLICATIONS

The present application claims priority to U.S. Provisional Patent Application No. 61/590,663, filed Jan. 25, 2012, and entitled "Rescue Craft", the disclosure of which is hereby incorporated by reference in its entirety.

TECHNICAL FIELD

The present disclosure relates to watercrafts for use in varying water environments. In particular, the present disclosure relates to an air-propelled watercraft having an inflatable hull for added stability.

BACKGROUND

Various types of rescue boats exist to navigate through rough water courses. One example of such a rescue craft is an air-propelled watercraft, or airboat. Typically, airboats provide air-propulsion to propel flat bottom-hulled boats through waterways. Such watercraft typically are relatively compact, allowing them to maneuver through brush, reeds, or other low-water conditions. As such, rescue boats typically include a metal or other hard, resilient hull, often constructed of aluminum.

Metal-hulled airboats are generally useable in low-water conditions, as opposed to traditional prop-driven watercraft. However, these airboats have drawbacks. For example, in the case of open water conditions, and in particular in windy conditions where currents or waves may be significant, traditional airboats become unstable, and could capsize. Even if they do not capsize in such conditions, often there are conditions in which it is unsafe to operate such rescue craft, such as in inclement weather conditions. Additionally, even in advantageous weather, such rescue craft have a limited cargo and/or passenger capacity, due in part to the shallow, low profile native of the hull.

For these and other reasons, improvements are desirable.

SUMMARY

In accordance with the following disclosure, the above and other issues are addressed by the following:

In a first aspect, a watercraft comprises a fan propeller, a motor coupled to the fan propeller, an inflatable hull comprising a first inflatable member and a second inflatable member, and a platform positioned between the first and second inflatable members and coupled to a base of the fan propeller. The motor powers the fan propeller and thereby propels the watercraft in a forward direction.

In a second aspect, an air-propelled watercraft includes an at least partially inflatable hull including a first inflatable member and a second inflatable member, and a platform, positioned between the first and second inflatable members. The watercraft further includes a metal frame supporting the platform and connecting the first and second inflatable members, the metal frame including a portion extending above the platform and connected to the first and second inflatable members. The watercraft also includes a fan propeller mounted to the metal frame in a generally rearward portion of the watercraft and at least partially enclosed by a metal cage affixed to the metal frame, and a rudder positioned rearward of the fan propeller and positioned to assist in steering the watercraft. The watercraft also includes a motor coupled to the fan propeller and configured to, during operation, power the fan propeller, thereby propelling the watercraft in a forward direction.

Detailed Description

Figure 1:
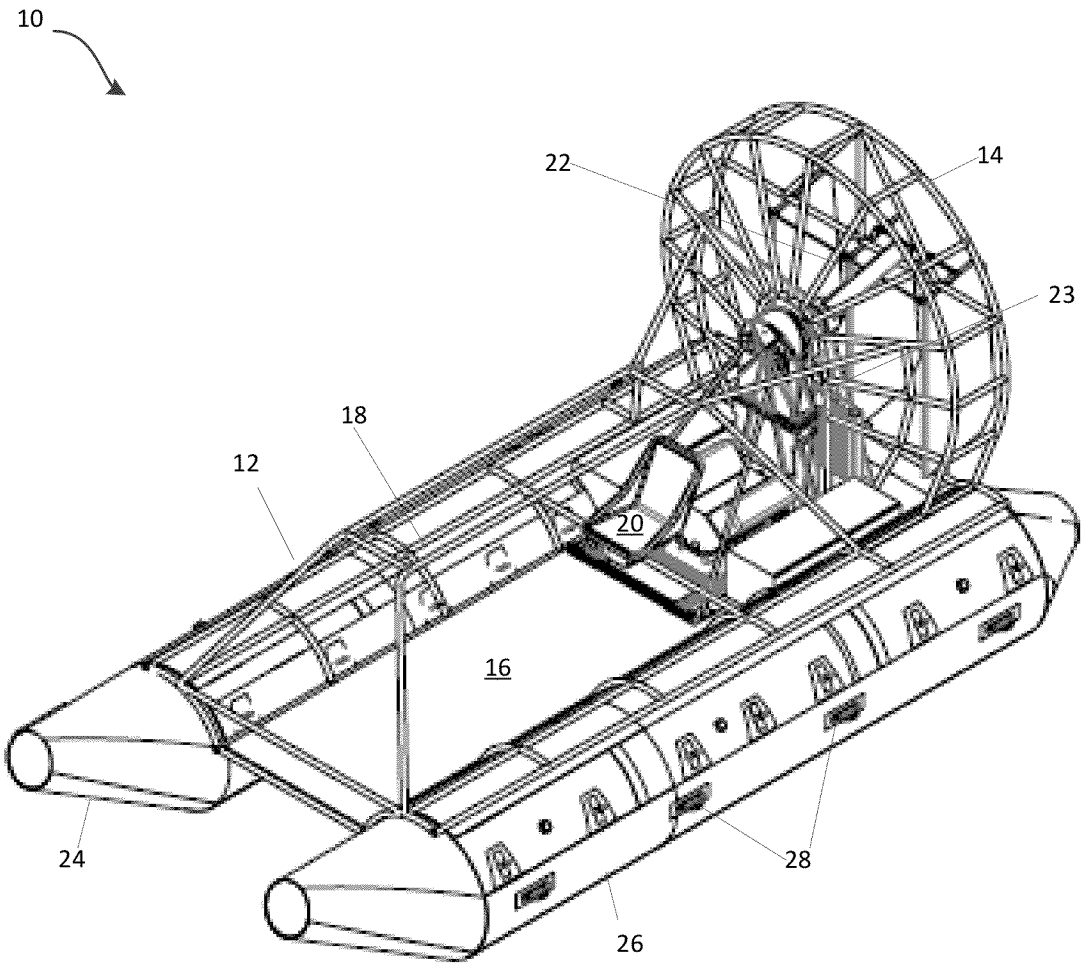
FIG. 1 is a perspective view of an example embodiment of an air-propelled watercraft, according to an example embodiment of the present disclosure.

Various embodiments of the present invention will be described in detail with reference to the drawings, wherein like reference numerals represent like parts and assemblies throughout the several views. Reference to various embodiments does not limit the scope of the invention, which is limited only by the scope of the claims attached hereto. Additionally, any examples set forth in this specification are not intended to be limiting and merely set forth some of the many possible embodiments for the claimed disclosure.

The present disclosure relates generally to an air-propelled watercraft, such as a rescue craft, having a hull that includes one or more inflatable elements. Through use of inflatable hull elements, the watercraft disclosed in the present disclosure provides improved flotation and stability in rough water, as well as improved carrying capacity, while maintaining maneuverability and flexibility in the variety of applications to which the watercraft can be applied.

Figure 2:
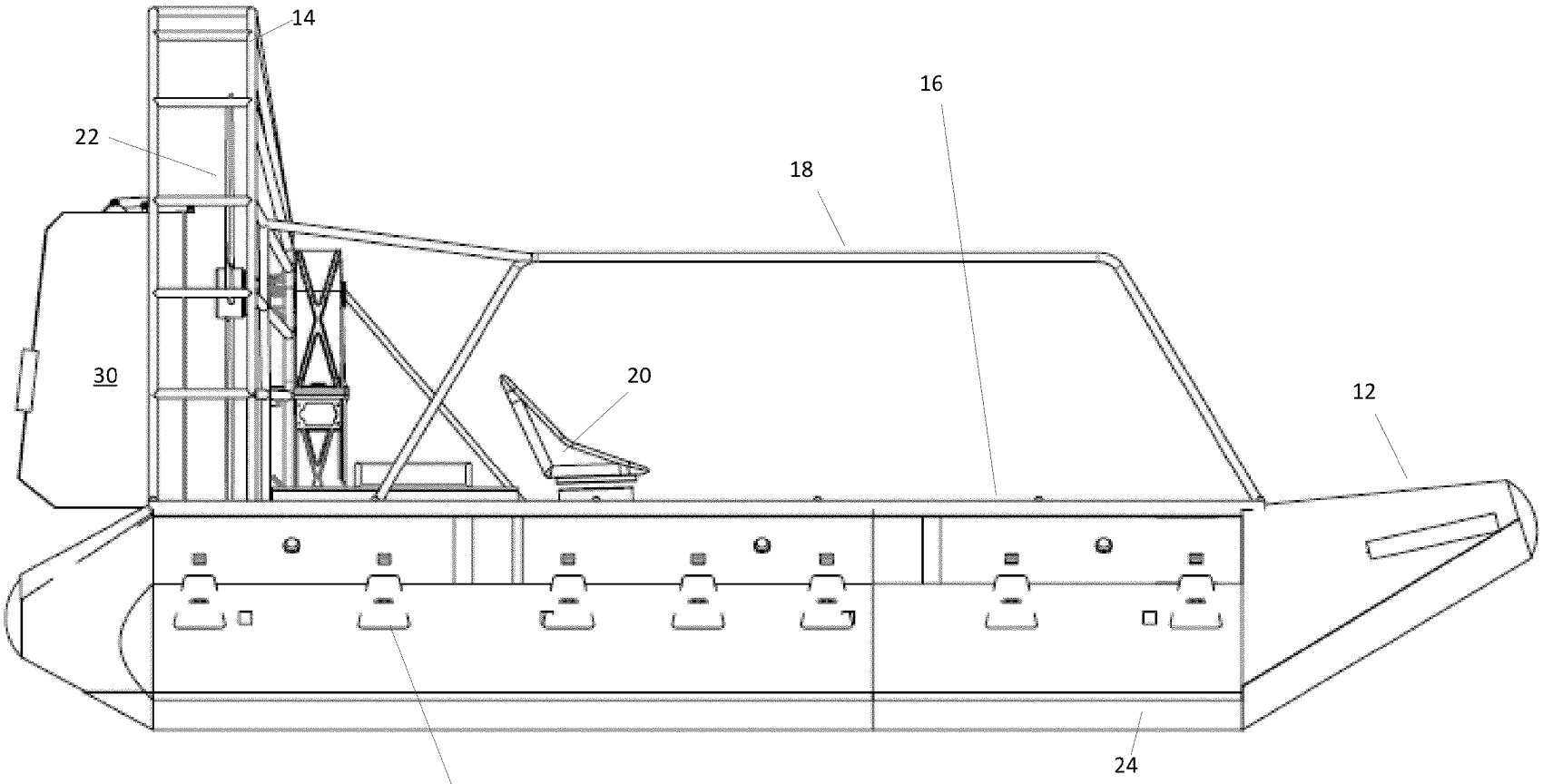
FIG. 2 is a side plan view of the watercraft of FIG. 1.

Referring now to FIG. 1 and FIG. 2, a perspective view and a side view of an example embodiment of a watercraft 10 are shown. The watercraft 10 includes a hull 12, a metal cage 14, a platform 16, a frame 18, and a seat 20. The metal cage 14 supports and surrounds a propeller 22 and a motor 23. The hull 12 includes a first sponson 24, a second sponson 26, and rub strakes 28.

In the embodiment shown, the hull 12 includes the first sponson 24 and the second sponson 26. The first and second sponsons 24, 26 are inflatable, forming an at least partially inflatable hull. The hull 12 provides stability and flotation to the watercraft 10 and enables the transport of loads or personnel. The sponsons 24, 26 are inflatable and provide support to both sides of the watercraft 10. In some alternative embodiments, the sponsons 24, 26 may be connected either at a bow or stern location (e.g., behind the propeller 22) to create a U-shaped hull. Other hull shapes are possible as well.

The sponsons 24, 26 are preferably scratch and abrasion resistant, and thus, may endure for long periods in rough water environments, including swift water, white water, open sea, ice, snow, and shallow water mixed with rocks and/or vegetation. For example, the watercraft 10 is designed to travel through 20 foot waves and/or water as shallow as 6 inches in depth, and other hazardous conditions including flood waters, rivers, and frozen lakes. The sponsons 24, 26 may also be unaffected by gas, oil, and diesel that may seep from the motor 23 or from other external or internal sources. Due to their inflatable characteristics, the sponsons 24, 26 act as bumpers and fenders and rebound off of objects that may exist in the trajectory of the watercraft 10, such as rocks, ice, other watercrafts, or the like. As such, the watercraft 10 is able to navigate through narrow passages without severe damage. In some embodiments, the sponsons 24, 26 are made from polyurethane and are thus bullet-proof to 9 mm. In other embodiments, the sponsons 24, 26 may be made from alternate materials and may be bullet-proof to varying degrees.

The sponsons 24, 26 may also be equipped with one or more baffles, or separable chambers, within the sponsons 24, 26. The baffles promote floatation of the hull 12 and prevent or mitigate the effects of vibrations, which are increased in rough water conditions. In other words, the baffles promote stability of the sponsons 24, 26, and ensure that a single puncture of a sponson would not immediately compromise flotation of the overall watercraft 10.

In some embodiments, the sponsons 24, 26 also may include rub strakes 28. The rub strakes 28 are located on the sides and/or bottom of the sponsons 24, 26. In other embodiments, the rub strakes 28 are located on any exterior surface of the sponsons 24, 26. The rub strakes 28 facilitate floatation by preventing water from entering the watercraft 10, and also minimize wear on sponsons 24, 26 by providing locations on the sponsons which receive the majority of wear from piers, underwater obstacles, or other possible collision/wear areas. Generally, the sponsons are designed to absorb collisions with and bounce off of rocks or other obstacles, acting as fenders for the watercraft 10. Although in the embodiment shown two sponsons 24, 26 are illustrated, in alternative embodiments additional sponsons could be included as part of the hull 12.

In the embodiment shown, the watercraft 10 includes a metal cage 14 which encloses the propeller 22 and the motor 23. The metal cage 14 prevents external objects such as debris from coming in contact with the propeller 22, which could cause damage to the watercraft 10 or any passengers or cargo being transported by the watercraft 10. Alternatively, the metal cage 14 prevents passengers or other internal cargo to contact the propeller 22, for example, if turbulent waters cause excessive movement of the watercraft 10. In other embodiments, the propeller 22 and the motor 23 may be enclosed by alternate methods, or may not be enclosed at all (e.g., if weight minimization is desired).

The propeller 22 is mounted in a generally rearward position on the watercraft 10, centrally located between and above the sponsons 24, 26. The propeller 22 is powered by the motor 23. The propeller 22, when driven by the motor, propels the watercraft 10 through the water. More specifically, the propeller 22 generates a rearward column of air that propels the watercraft 10 in a forward direction. In an example embodiment, the propeller 22 may propel the watercraft 10 at speed of up to 40 miles per hour. In some embodiments, the propeller 22 is a composite fan propeller. However, in other embodiments, the propeller 22 may be made from aluminum, stainless steel, bronze, nibral, or a combination of one or more of those materials or any other suitable material.

In some embodiments, the motor 23 is made from aluminum and weighs approximately 500 lbs. For example, in one embodiment, an aluminum marinized 450 horsepower motor is utilized. In other embodiments, a 425 horsepower motor is used. In yet alternative embodiments, the motor 23 is made from any suitable material and may have varying weights depending on the material used and other like factors. The motor 23 is powered by fuel that is held in a fuel tank (not shown). The fuel tank may have varying capacities, such as, for example, a fifty gallon capacity.

The watercraft 10 also includes the platform 16 which provides a support for the watercraft 10. The platform 16 is a firm or semi-firm surface which accommodates passengers and cargo. In some embodiments, the platform 16 may support up to 15 passengers or 2,250 pounds in cargo, based on the size of the platform and overall flotation of the watercraft 10. The platform 16 is supported by the hull 12. In some embodiments, the platform 16 has an open-cell arrangement, allowing water drainage as necessary through the platform to the water surface.

The platform is connected to a metal frame 18 which adds additional support and stability to the entire watercraft 10. The metal frame extends from the cage 14 forward toward the bow of the watercraft 10, at a height generally sufficient to be above a head of a seated passenger in seat 20, or to be held by a standing passenger. In the embodiment shown, the metal frame 18 includes a plurality of rails running along a length of the boat, and connecting to a lower portion of the frame at a front portion of the platform 16. The metal frame thereby supports and maintains the positional relationships of the motor 23, propeller 22, platform 16, and sponsons 24, 26.

Furthermore, the metal frame 18 functions as a support for passengers to grasp while the watercraft 10 is in motion. The platform 16 supports the seat 20, which can be used for the driver of the watercraft 10 or for any other passengers aboard the watercraft 10. In alternate embodiments, more or less than one seat may be positioned on and coupled to the platform 16.

Figure 3:
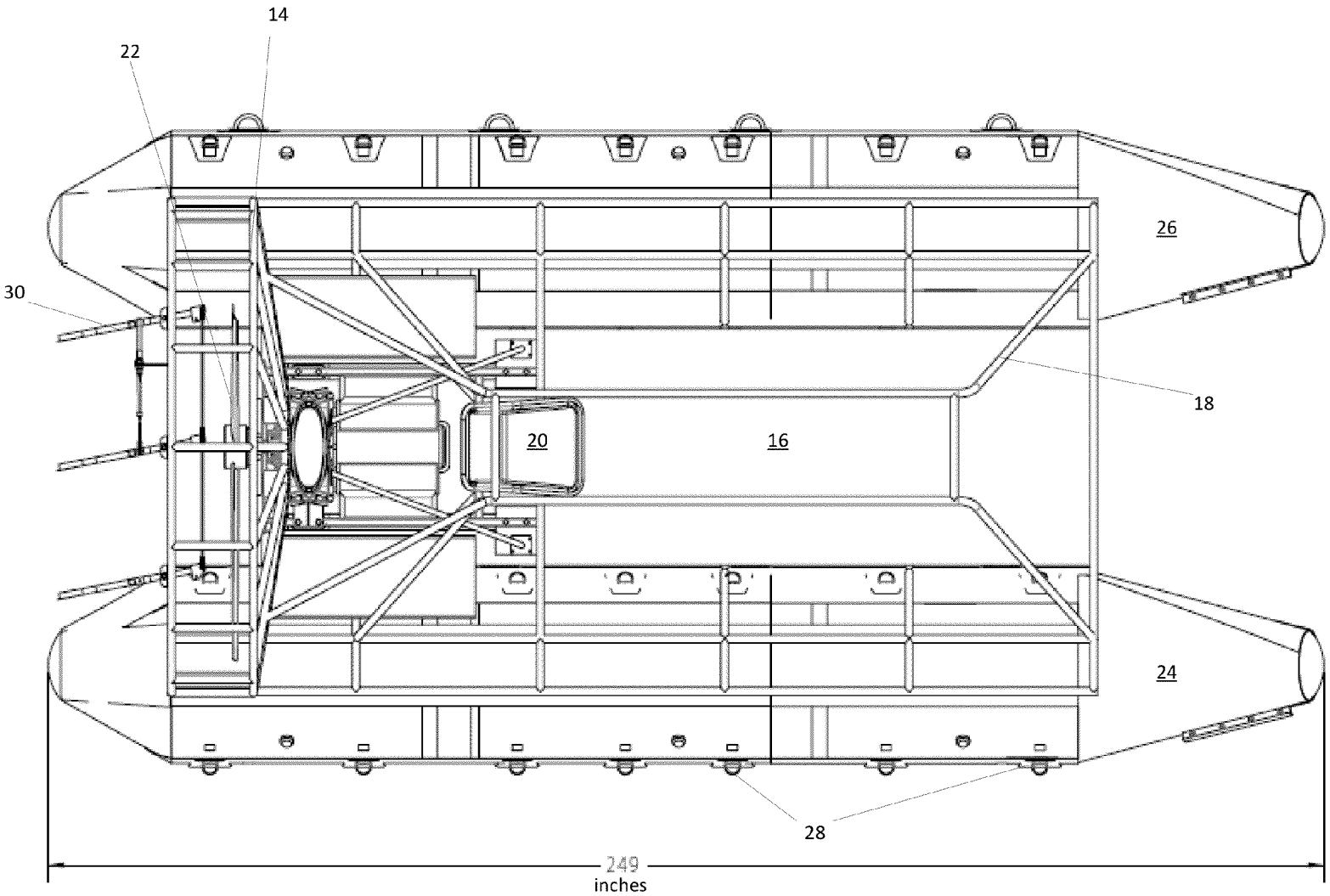
FIG. 3 is a top plan view of the watercraft of FIG. 1.

As illustrated in FIGS. 2-3, the seated driver can steer the watercraft based on control of (1) the motor 23 (and accordingly rotational velocity of the propeller 22), as well as control of one or more rudders 30 positioned rearward of the metal cage 14. The rudders 30 act to divert airflow from the propeller 22, thereby causing the watercraft to turn as desired. Although in the embodiment shown three rudders are depicted, it is understood that more or fewer rudders could alternatively be used.

Figure 4:
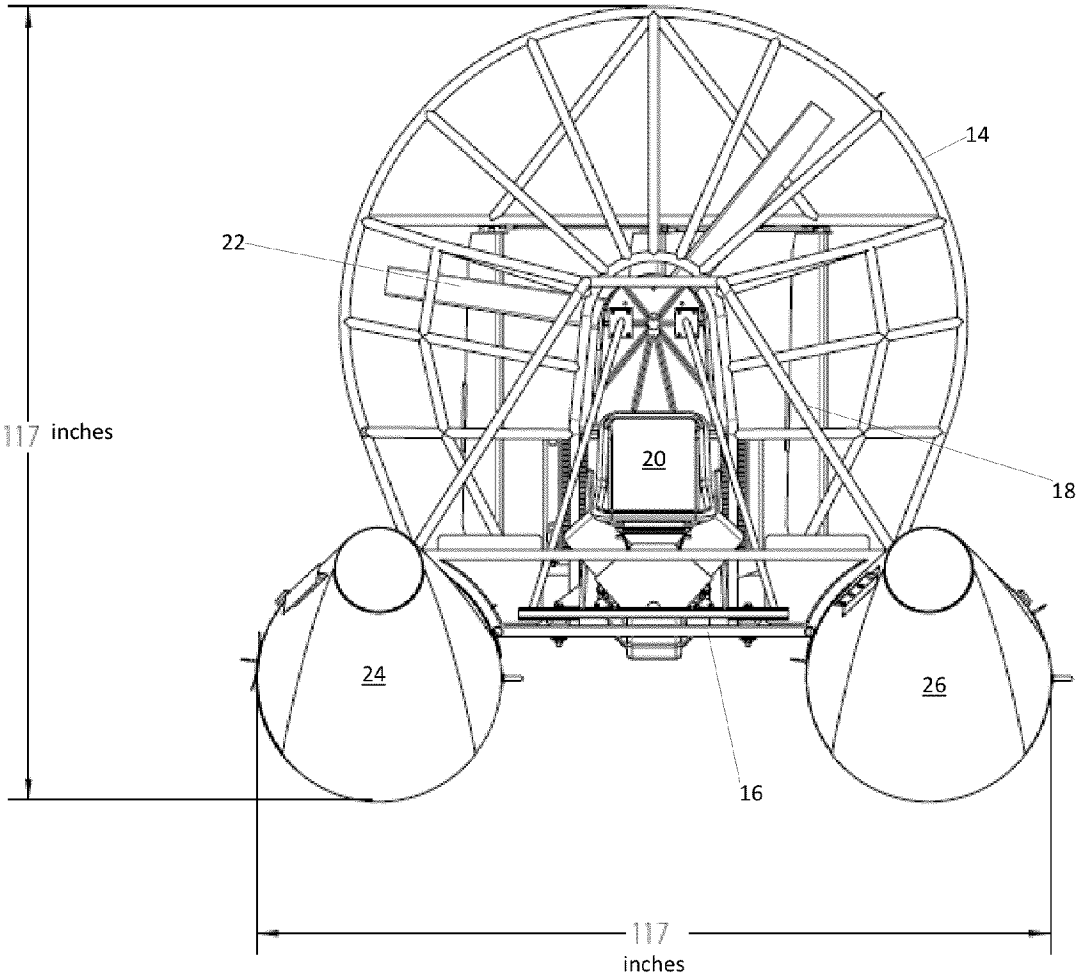
FIG. 4 is a front plan view of the watercraft of FIG. 1.

Referring now to FIGS. 3 and FIG. 4, a top view and a front view of the watercraft 10 are shown. Furthermore, example dimensions for one embodiment of the watercraft 10 are presented.

As shown in FIG. 3, the watercraft 10 has a length, measured from a front tip of the first sponson 24 to a back tip of the first sponson 24, of about 249 inches or about 20.75 feet. In alternative embodiments, the length of the watercraft 10 may be about 20 feet. In yet other embodiments, the length of the watercraft 10 may be within the range of about 15 feet to about 25 feet.

Now referring to FIG. 4, the watercraft 10 has a width, measured from an outside surface of the first sponson 24 to an outside surface of the second sponson 26, of about 117 inches or about 9.75 feet. In alternative embodiments, the width of the watercraft 10 may be about 10 feet. In yet other embodiments, the width of the watercraft 10 may be within the range of about 5 feet to about 15 feet.

The watercraft 10 also has a height, measured from a bottom surface of the first sponson 24 to a top surface of the metal cage 14, of about 117 inches or about 9.75 feet. In alternative embodiments, the height of the watercraft 10 may be 9 feet. In yet other embodiments, the height of the watercraft 10 may be within the range of about 4 feet to about 15 feet.

Overall, the watercraft 10 can be a variety of weights; in some examples, the watercraft 10 weighs less than 2,000 pounds, and in a particular example embodiment weighs approximately 1500 pounds. However, in alternative embodiments, and depending upon the particular configuration of sponsons 24, 26, metal cage 14, motor 23, and other components, other weights may be possible as well.

Referring to FIGS. 1-4 generally, it is recognized that the watercraft disclosed herein has a number of advantages over existing rigid-hull airboats or other watercraft. In particular, the watercraft disclosed herein remains compact and maneuverable, while allowing for improved buoyancy and handling in open water and adverse weather conditions. Additionally, the watercraft includes additional capacity, which can be useful in emergency rescue conditions where use of an airboat (as opposed to traditionally prop-driven watercraft) may be desirable.

The above specification and examples provide a complete description of the manufacture and use of the composition of the invention. Since many embodiments of the invention can be made without departing from the spirit and scope of the invention, the invention resides in the claims hereinafter appended.

The invention claimed is:

1. A watercraft comprising:

a fan propeller;

a motor coupled to the fan propeller;

an inflatable hull comprising a first inflatable member and a second inflatable member, each inflatable member having a substantially cylindrical shape with tapered front and rear ends, the first inflatable member spaced from and substantially parallel to the second inflatable member; and a platform, mounted to a top portion of and positioned between the first and second inflatable members and coupled to a base of the fan propeller;

wherein the motor powers the fan propeller, and wherein the fan propeller is supported on a rear portion of the platform and positioned proximate the rear ends of the inflatable members, the fan propeller configured to propel the inflatable hull in a forward direction.

2. The watercraft of claim 1 further comprising a metal frame including a portion positioned above the platform, the metal frame connected to the first and second inflatable members.

3. The watercraft of claim 1, wherein the fan propeller and the motor are enclosed by a metal cage.

4. The watercraft of claim 1, wherein the watercraft is configured to operate in one or more conditions including white water, open sea water, ice, snow, and shallow water conditions.

5. The watercraft of claim 1, further comprising a seat coupled to the platform.

6. The watercraft of claim 1, wherein the first and second inflatable members each include a plurality of rub strakes positioned on external surfaces of the first and second inflatable members.

7. The watercraft of claim 1, wherein the platform has an open cell arrangement.

8. The watercraft of claim 1, wherein the first and second inflatable members are directly coupled.

9. The watercraft of claim 1, wherein the watercraft is configured to travel at speeds up to 40 miles per hour.

10. The watercraft of claim 1, wherein the first and second inflatable members comprise sponsons.

11. The watercraft of claim 1, wherein the watercraft has a length of about 20 feet.

12. The watercraft of claim 11, wherein the watercraft has a width of about 10 feet

13. The watercraft of claim 12, wherein the watercraft has a height of about 9 feet.

14. The watercraft of claim 1, further comprising a rudder positioned rearward of the propeller and configured to assist in steering the watercraft.

15. An air-propelled watercraft comprising:

an at least partially inflatable hull including a first inflatable member and a second inflatable member, each inflatable member having a substantially cylindrical shape with tapered front and rear ends, the first inflatable member spaced from and substantially parallel to the second inflatable member;

a platform, mounted to a top portion of and positioned between the first and second inflatable members;

a metal frame supporting the platform and connecting the first and second inflatable members, the metal frame including a portion extending above the platform and connected to the first and second inflatable members;

a fan propeller mounted to the metal frame in a generally rearward portion of the watercraft and supported proximate the rear ends of the inflatable members, the fan propeller at least partially enclosed by a metal cage affixed to the metal frame;

a rudder positioned rearward of the fan propeller and positioned to assist in steering the watercraft; and a motor coupled to the fan propeller and configured to, during operation, power the fan propeller, thereby propelling the watercraft in a forward direction.

16. The air-propelled watercraft of claim 15, wherein the watercraft has a weight less than 2,000 pounds.

17. The air-propelled watercraft of claim 15, wherein the watercraft is operable in water having a depth of about 6 inches.

18. The air-propelled watercraft of claim 15, wherein the watercraft is configured to operate in one or more conditions including white water, open sea water, ice, snow, and shallow water conditions.

* * * * *